US005574264A

United States Patent [19]

Takemori et al.

[11] Patent Number: 5,574,264

[45] Date of Patent: Nov. 12, 1996

[54] ACTIVE EXHAUST-NOISE ATTENUATION MUFFLER

[75] Inventors: Yoshihisa Takemori; Hiroshi Soma, both of Tokyo, Japan

[73] Assignee: Calsonic Corporation, Tokyo, Japan

[21] Appl. No.: 288,184

[22] Filed: Aug. 9, 1994

[30] Foreign Application Priority Data

Aug. 12, 1993 [JP] Japan ..... 5-044258 U

[51] Int. Cl.[6] ..... F01N 1/06

[52] U.S. Cl. ..... 181/206; 181/228; 381/71

[58] Field of Search ..... 181/206, 227, 181/228, 249, 252, 232, 282; 381/71

[56] References Cited

U.S. PATENT DOCUMENTS

| | | | |
|---|---|---|---|
| 2,929,462 | 3/1960 | Nowak | 181/228 |
| 3,786,791 | 1/1974 | Richardson | 181/227 |
| 4,444,288 | 4/1984 | Sekiya et al. | 181/252 X |
| 4,665,549 | 5/1987 | Eriksson et al. | 381/71 |
| 5,119,902 | 6/1992 | Geddes | 181/206 |
| 5,272,286 | 12/1993 | Cain et al. | 181/206 |
| 5,371,331 | 12/1994 | Wall | 181/227 |

FOREIGN PATENT DOCUMENTS

| | | |
|---|---|---|
| 3-174198 | 7/1991 | Japan . |
| 4-11207 | 1/1992 | Japan . |

*Primary Examiner*—Khanh Dang
*Attorney, Agent, or Firm*—Foley & Lardner

[57] ABSTRACT

An electronically controlled active exhaust-noise attenuation muffler, comprises a loudspeaker serving as a secondary sound source arranged upstream of a tailpipe and communicating with an interior of an exhaust pipe, for attenuating a noise level of exhaust noise produced by the exhaust system by emitting a secondary sound, which is in opposite phase to the exhaust noise, into the exhaust pipe. The tailpipe is formed in a flared-out fashion so that a cross-sectional area of the tailpipe gradually increases towards a downstream end thereof, to reduce pressure loss in exhaust gas flow in the exhaust pipe by radiating the exhaust gas through the flared-out tailpipe. The tailpipe section is a high-frequency exhaust noise attenuation structure to attenuate a high-frequency noise component propagated with a moving stream of the exhaust gases.

3 Claims, 4 Drawing Sheets

(PRIOR ART) (PRIOR ART)

ACTIVE EXHAUST-NOISE ATTENUATION MUFFLER

BACKGROUND OF THE INVENTION

1. Field of the Invention

The present invention relates to an electronically controlled active exhaust-noise attenuation muffler which positively attenuates a noise level of the exhaust system by utilizing a secondary sound source such as a loudspeaker provided in the muffler.

2. Description of the Prior Art

In recent years, there have been proposed and developed various active sound absorbing type mufflers equipped with a secondary sound source such as a loudspeaker provided in the muffler, in order to actively attenuate exhaust noise corresponding to a primary sound by utilizing a secondary sound created by the secondary sound source. Such active sound absorbing type mufflers have been disclosed in Japanese Patent First Publication (Tokkai Heisei) No. 3-174198 and Japanese Utility Model First Publication (Jikkai Heisei) No. 4-11207.

Referring now to FIG. 5, there is shown the conventional active sound absorbing type muffler with a secondary sound source. The active sound absorbing type muffler will be hereinafter abbreviated as an "active muffler". In FIG. 5, an exhaust pipe 11 is connected to a muffler body 13, so as to properly reduce the noise of exhaust gases G flowing therethrough. Reference numeral 15 denotes a tailpipe extending from the muffler body 13 to the rear of the vehicle. A penetration portion of the exhaust pipe 11, which is centrally located in the muffler body 13 in such a manner as to pass through the latter, is formed with perforations 17. In general, the space defined between the outer shell 14 of the muffler body 13 and the centrally located penetration portion of the exhaust pipe 11, is filled with glass wool, steel wool, or some other heat-resistant sound deadner (sound absorption material) 19. A support member 21 is provided between the outer shell 14 of the muffler and the centrally located pipe section in order to support a loudspeaker (as explained later) at a given distance from the outer periphery of the centrally located pipe section. The support member 21 has an opening 25 at which a loudspeaker 27 functioning as a secondary sound source is provided. A microphone 29 is also provided in the centrally located penetration portion of the exhaust pipe 11, to detect the noise of exhaust gases G flowing through the pipe 11, namely a frequency of the exhaust noise and an amplitude of the noise. In actual, an active sound absorbing operation of the typical active muffler is achieved by transmitting a secondary sound which is in opposite phase to the detected noise of the exhaust gas G, by virtue of the speaker 27. In such a conventional active muffler with a secondary sound source, the speaker 27 which serves as a secondary sound source is arranged to emit the secondary sound directly to the exhaust flow in the centrally located pipe section of the exhaust pipe 11, for the purpose of exhaust noise reduction. Therefore, an actual neutral position of the vibrating surface 33 of the speaker 27 would be shifted from a predetermined design neutral point or position, owing to an increase in static pressure P acting on the front side of a vibrating surface 33 of the speaker 27, based on an increase in a flow velocity V of the exhaust gas G as illustrated in FIG. 6. This is because the increase in the flow velocity V of the gas G results in an increase in pressure loss in the exhaust gas flow. Due to the increase in static pressure P, the deviation of the actual neutral position of the vibrating surface 33 relative to the design neutral position, results in a decrease in desired displacement of the vibrating surface 33 of the speaker 27. As a result, a noise reduction performance in the exhaust system may be lowered. In more detail, in the event that two static pressure levels both at the front and rear sides of the vibrating surface 33 of the speaker are balanced to each other, the vibrating surface 33 can oscillate with a maximum permissible amplitude $\delta$ at an actual vibrating neutral position equivalent to a predetermined design neutral position, as seen in FIG. 7(*a*). In contrast to the above, in the event that the actual vibrating position of the vibrating surface 33 is slightly displaced from the predetermined design neutral position owing to the increase in static pressure P, the amplitude of the vibrating surface 33 may be undesirably reduced to a value $\delta'$, as seen in FIG. 7(*b*). This tends to deteriorate a noise reduction performance of the exhaust system. As is generally known, the previously-noted conventional active muffler is most effective to attenuate a particular exhaust noise which is within a particular frequency range of 20 Hz to 500 Hz. However, upon the engine revolution has reached to a high revolution, a higher-order wave propagation component, particularly a secondary component of the noise of combustion and exhaust of an internal combustion engine can be generated by exhaust flow past a sharp edge in the exhaust train, venturi noise in the carburetor and friction between forceful exhaust flow and respective pipes, namely the exhaust pipe and the tailpipe. In general, such a secondary noise component is a high-frequency noise having frequencies above 500 Hz. The conventional active muffler also suffers from the drawback that the high-frequency noise component which is missed by the prior art active muffler may be emitted from the muffler unit via the tailpipe into the atmosphere at the rear of the car, without any noise reduction effects.

SUMMARY OF THE INVENTION

Accordingly, it is an object of the present invention to provide an improved electronically controlled active exhaust-noise attenuation muffler with a secondary sound source which muffler avoids the foregoing disadvantages of the prior art.

It is another object of the invention to provide an improved active muffler with a secondary sound source which muffler is capable of reducing pressure-loss in the exhaust gas flow downstream of a secondary sound source and of effectively reducing a high-frequency noise component propagated with a moving stream of exhaust gases.

It is a further object of the invention to provide an improved active muffler system with a secondary sound source which system has wide frequency-range noise attenuation characteristics.

In order to accomplish the aforementioned and other objects of the invention, an active exhaust-noise attenuation muffler, comprises a secondary sound source arranged upstream of a tailpipe of an exhaust system and communicating with an interior of an exhaust pipe of the exhaust system, for attenuating a noise level of exhaust noise produced by the exhaust system by emitting a secondary sound, being in opposite phase to the exhaust noise, into the exhaust pipe. The tailpipe is formed in a flared-out fashion so that a cross-sectional area of the tailpipe gradually increases towards its downstream end, to reduce pressure loss in an exhaust gas flow in the exhaust pipe by radiating the exhaust gas through the flared-out tailpipe. A high-frequency exhaust noise attenuation means is also arranged at the tailpipe for attenuating a high-frequency noise component propagated with a moving stream of the exhaust gas.

DESCRIPTION OF THE PREFERRED EMBODIMENTS

First Embodiment

Figure 1:
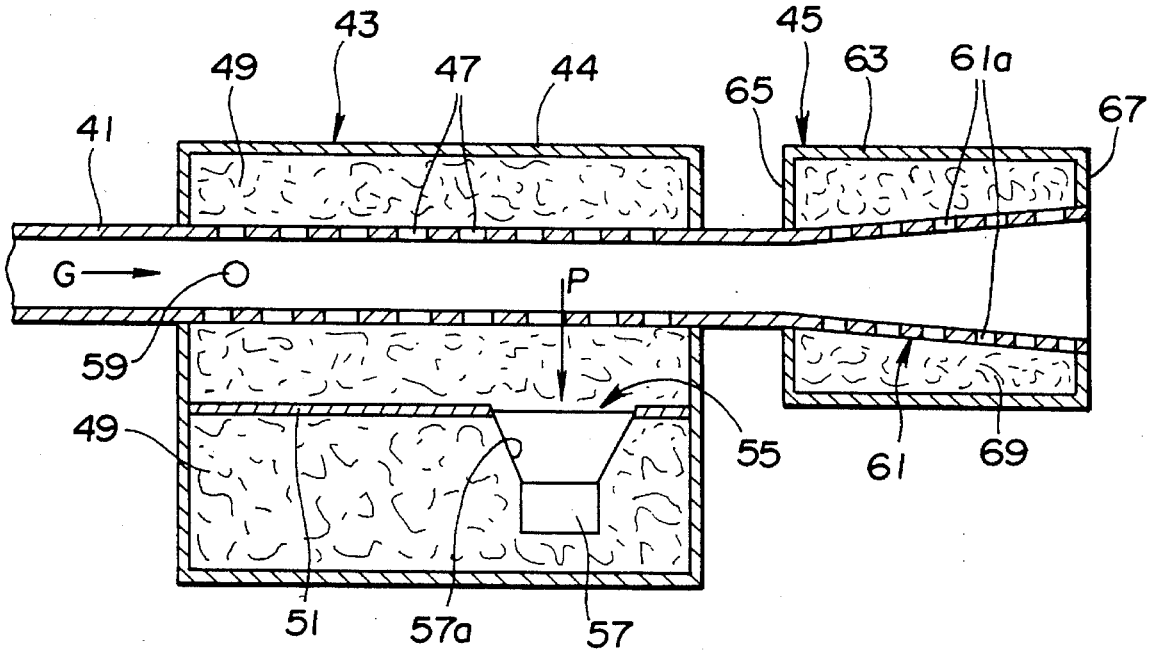
FIG. 1 is a longitudinal cross-sectional view illustrating a first embodiment of an active muffler according to the invention.

Referring now to the drawings, particularly to FIG. 1, an active muffler of the invention is exemplified in case of a straight-through type muffler which is applicable to an exhaust system of an internal combustion engine. The active muffler includes a muffler body 43 through which an exhaust pipe 41 passes. The exhaust system in general has a tailpipe section 45 in addition to an exhaust manifold (not shown), the exhaust pipe 41 and the muffler 43. The exhaust gases G are emitted through the tailpipe section 45 into the atmosphere. A portion of the exhaust pipe 41 penetrates the muffler body 43 in a manner so as to be centrally located in the muffler body 43. The penetration portion of the exhaust pipe 41 is formed with a great number of perforations 47. The internal space defined between the outer shell 44 of the muffler body 43 and the centrally located penetration portion of the exhaust pipe 41, is filled with heat-resistant sound deadner or sound absorption material 49, such as glass wool, steel wool, or the like. A support member 51 is provided between the outer shell 44 of the muffler and the centrally located penetration portion of the exhaust pipe 41, to support a loudspeaker 57 at a given distance from the outer periphery of the centrally located pipe section. The support member 51 has an opening 55. The speaker 57 serving as a secondary sound source is disposed at the opening 55. Also disposed in the exhaust pipe 41 is a microphone 59, in order to monitor the exhaust noise being propagated in conjunction with a moving stream of exhaust gases. The previously-noted construction of the active muffler is well known. In the active muffler of the first embodiment, note that an end portion 61 of the tailpipe section 45 is designed so that the inside diameter or cross-sectional area of the end portion 61 gradually increases towards the downstream end thereof. In other words, the end portion 61 of the tailpipe is produced by flaring out a substantially circular tube into the shape of a horn. As seen in FIG. 1, the horn-shaped or flared-out end portion 61 is inserted into a substantially cylindrical outer shell 63. Both opening ends of the cylindrical outer shell 63 are closed by means of a pair of substantially annular end plates 65 and 67 in an air-tight fashion. A penetration portion of the flared-out end portion 61 of the tailpipe, which penetrates the outer shell 63, is formed with a great number of perforations 61*a*. Additionally, an internal space defined between the outer shell 63 and the penetration portion of the flared-out end portion 61 is filled with heat-resistant sound deadner or sound absorption material 69, such as glass wool, steel wool, or the like. In the active muffler of the first embodiment, an active exhaust-noise attenuation operation is achieved in a conventional manner, as follows. The exhaust noise of the exhaust gas G flowing through the exhaust pipe 41 is first monitored by way of the microphone 59. Thereafter, the speaker 57 serving as the secondary sound source emits a secondary sound which is in opposite phase to the detected exhaust noise of the exhaust gas G, whereby the primary sound wave being propagated with the exhaust gas flow can be superposed on the secondary sound wave having the opposite phase to the primary sound wave, for active exhaust-noise attenuation. As appreciated from the explanation of the prior art, the active muffler section located upstream of the tailpipe section 45 is effective to reduce the low- and mid-ranges of frequencies in the exhaust noise. In addition to the above, the active muffler of the first embodiment is formed with the flared-out end portion 61 at the tailpipe section 45 and the flared-out end portion 61 acts to radiate the exhaust gases through the tailpipe section 45, thereby reducing pressure loss in the exhaust gas flow downstream of the speaker 57 and, consequently, preventing the static pressure P acting on the front face of the vibrating surface 57*a* of the speaker 57 from undesirably increasing owing to the increase in the flow velocity V of the exhaust gas G. That is, the flared-out end portion 61 acts to hold the static pressure applied onto the vibrating surface 57*a* at a constant pressure level substantially equal to the atmospheric pressure, irrespective of variations in the flow velocity V of the exhaust gas flowing through the exhaust pipe 41. Thus, the deviation between the design neutral position of the vibrating surface 57*a* and the actual neutral position can be certainly reduced at a minimum, thereby ensuring a maximum permissible amplitude of the vibrating surface 57*a*. Accordingly, the active muffler of the first embodiment can provide adequate exhaust-noise attenuation effects in the low- and mid-ranges of frequencies. Furthermore, in the active muffler of the first embodiment, the tailpipe section 45 having a high-frequency range attenuation characteristic is incorporated to effectively reduce the high-frequency components of the exhaust noise. That is, the tailpipe section 45, which consists of the flared-out end portion 61 with the penetration portion having the perforations 61*a*, the outer shell 63, the two end plates 65 and 67, the heat-resistant sound deadner 69, functions as a high-frequency exhaust-noise attenuation means. For this reason, suitably tuned are geometry and dimensions of each perforation 61*a* and the interval between the two adjacent perforations 61*a*, and a material of the sound deadner 69, so that the high-frequency exhaust-noise attenuation means is effective to reduce the high-frequency noise missed by the muffler section with the secondary sound source, namely the speaker 57.

Figure 2:
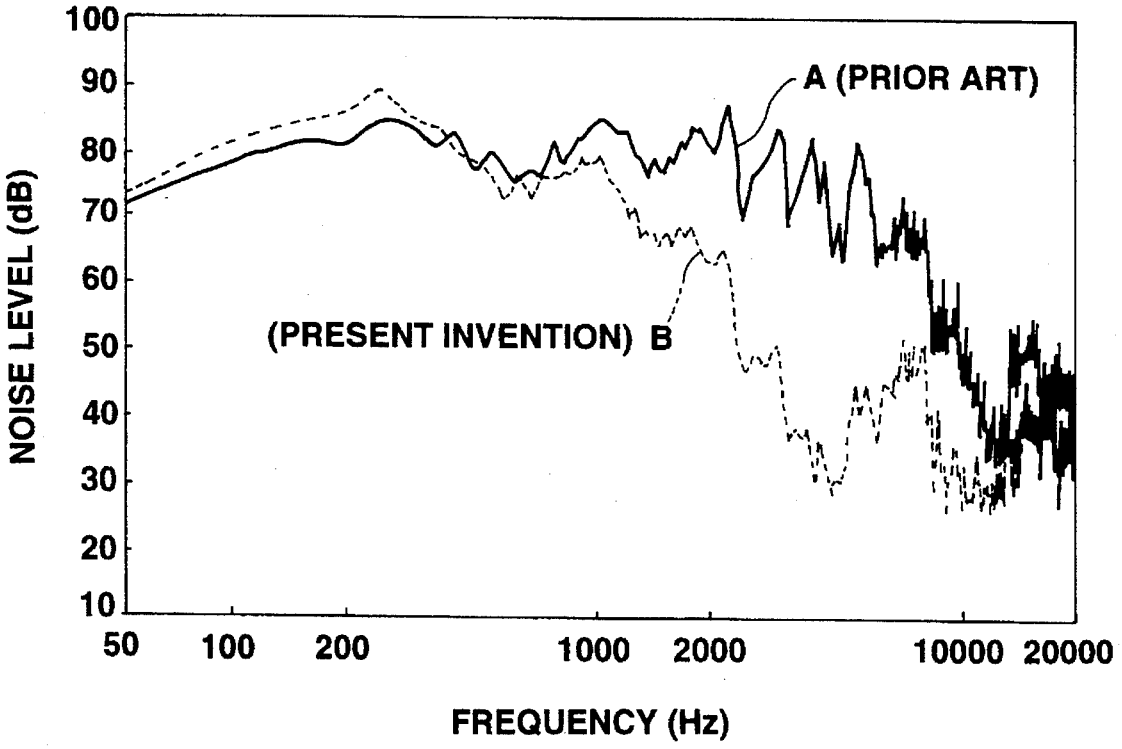
FIG. 2 is an explanatory view representative of noise attenuation effects of the active muffler of the invention in comparison with the prior-art active muffler.

Referring to FIG. 2, there is shown a frequency versus exhaust-noise level characteristic both in case of the prior art active muffler and the improved active muffler of the first embodiment. The noise level is illustrated in terms of a sound pressure (dB). It will be appreciated from the test results illustrated in FIG. 2 that the noise attenuation characteristic denoted by the character B (invention) is kept at a comparatively low level, as compared with the noise attenuation characteristic denoted by the character A (prior art). As clearly seen in FIG. 2, the noise attenuation characteristic of the active muffler of the first embodiment is remarkably improved particularly at the frequency range above 500 Hz.

Second Embodiment

Figure 3:
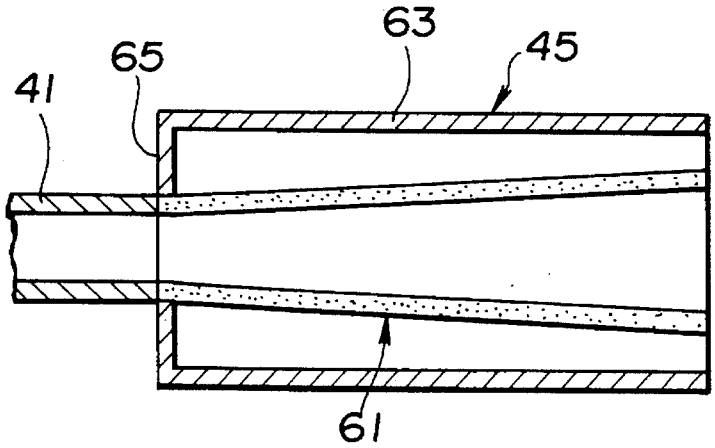
FIG. 3 is a longitudinal cross-sectional view illustrating a second embodiment of the active muffler according to the invention.
Figure 4:
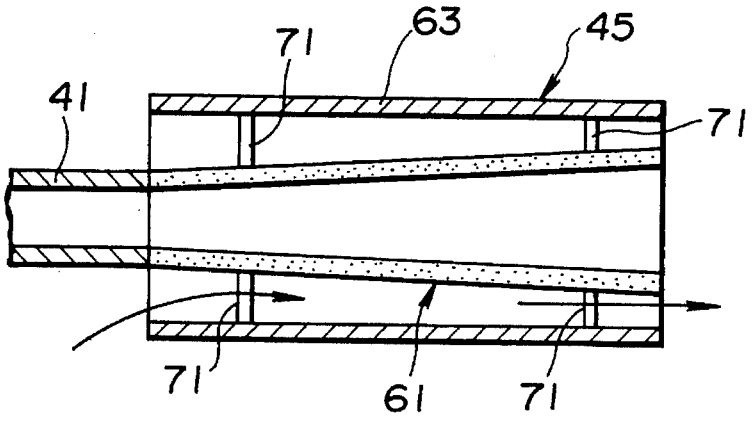
FIG. 4 is a longitudinal cross-sectional view illustrating a third embodiment of the active muffler according to the invention.
Figure 5:
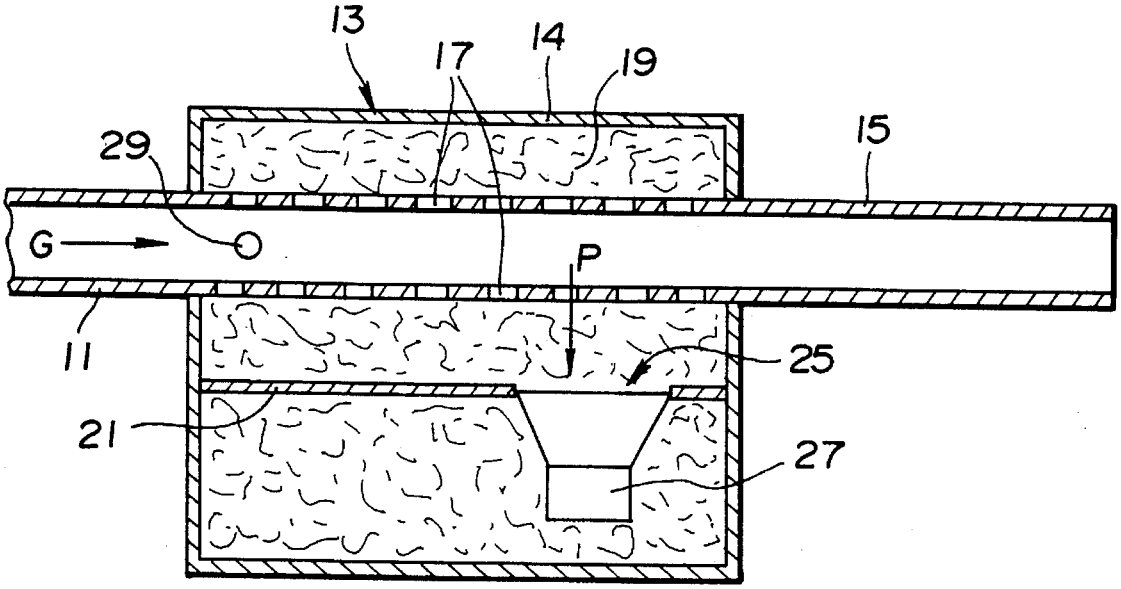
FIG.5 (PRIOR ART)
FIG. 5 is a longitudinal cross-sectional view illustrating one example of a prior art active muffler.
Figure 6:
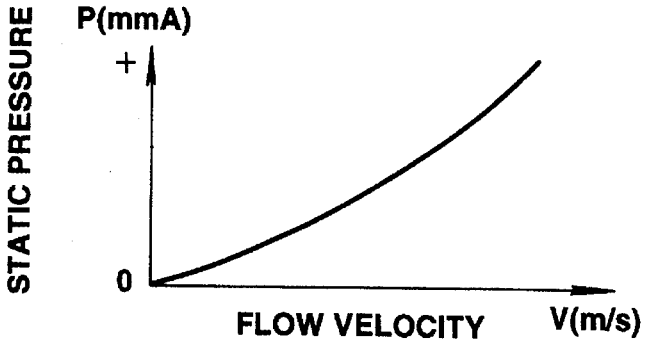
FIG.6 (PRIOR ART)
FIG. 6 is an explanatory illustration of a relation between a flow velocity of exhaust gas and a static pressure acting on the vibrating surface of a secondary sound source in the conventional active muffler shown in FIG. 5.
Figures 7A, 7B:
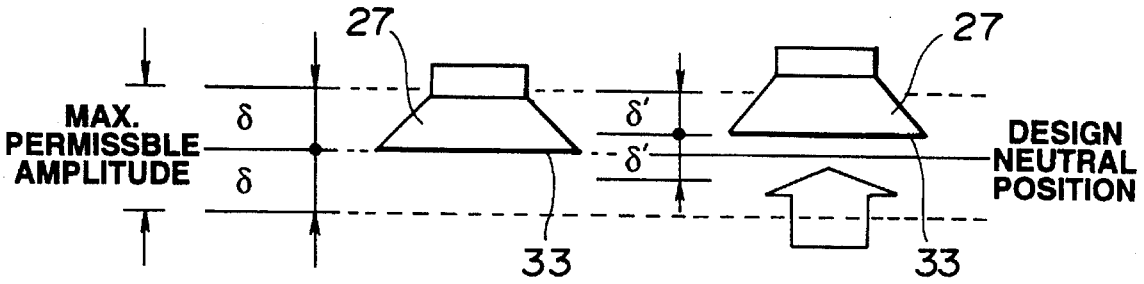
FIGS. 7(*a*) and 7(*b*) are explanatory illustrations indicative of the displacement of the vibrating surface of the secondary sound source from a predetermined design neutral position, in the conventional active muffler shown in FIG. 5.

Referring now to FIG. 3, there is shown the second embodiment of the active muffler according to the invention. The basic construction of the active mufflers of another embodiments as shown in FIGS. 3 and 4 are similar to that of the first embodiment as shown in FIG. 1. Therefore, the same reference numerals used in the first embodiment of FIG. 1 will be applied to the corresponding elements used in another embodiments of FIGS. 3 and 4, for the purpose of comparison between the first, second, and third embodiments. The active muffler of the second embodiment is different from that of the first embodiment in that the flared-out end portion 61 of the tailpipe section 45 is made of porous material, for instance sintered materials or foamed materials, in lieu of the perforations 61*a*, and that only one opening end of the outer shell 63 is hermetically closed by the end plate 65 and the other opening end of the outer shell 63 is fully opened, and that the internal space between the outer shell 63 and the flared-out end portion made of porous material is open without any heat-resistant sound deadner. It is experimentally assumed by the inventors of the present invention that the active muffler of the second embodiment also can provide substantially the same noise attenuation effects as the first embodiment. That is, the flared-out end portion 61 made of porous material functions in the same manner as the high-frequency exhaust-noise attenuation means of the first embodiment.

Third Embodiment

Referring now to FIG. 4, there is shown the third embodiment of the active muffler of the invention. The active muffler of the third embodiment is different from that of the second embodiment in that the cylindrical outer shell 63 is supported on the flared-out end portion 61 (made of porous material) of the tailpipe section 45 by means of at least one support member 71. As appreciated from the arrow shown in FIG. 4, which arrow indicates a flow of atmospheric air, the support member 71 is provided in a manner which permits atmospheric air to flow through both upstream and downstream opening ends of the outer shell 63 via the support member 71. In this case, the flared-out end portion 61 made of porous material functions as the high-frequency exhaust-noise attenuation means. In addition, the exhaust temperature of the gases G is effectively cooled by flow of the atmospheric air passing through both opening ends of the outer shell 63, before the gases G are discharged from the tailpipe section 45 to the atmosphere.

In the above-explained embodiments, although the active muffler of the invention is applied to a straight-through type muffler with a secondary sound source such as a loudspeaker, the concept of the active muffler of the invention may be applied to a usual reverse-flow type muffler with a secondary sound source.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. An active exhaust-noise attenuation muffler, comprising:

a tailpipe included in an exhaust system;

an exhaust pipe included in the exhaust system;

a microphone arranged in said exhaust pipe for monitoring an exhaust noise being propagated with a moving stream of an exhaust gas flowing through the exhaust pipe;

a secondary sound source including a loudspeaker arranged upstream of said tailpipe and communicating with an interior of the exhaust pipe for attenuating low- and mid-ranges of frequencies below 500 Hz in the exhaust noise by emitting a secondary sound, which is in opposite phase to the monitored exhaust noise, into the exhaust pipe;

said tailpipe being formed in a flared-out manner so that a cross-sectional area of said tailpipe gradually increases towards a downstream end of said tailpipe, for maintaining a noise-attenuation effect provided by said loudspeaker at a high level by holding a static pressure acting on a vibrating surface of said loudspeaker at a pressure level equal to an atmospheric pressure by radiation of the exhaust gas through said tailpipe; and a high-frequency exhaust noise attenuation means arranged at said tailpipe for attenuating a high-frequency noise component above 500 Hz in the exhaust gas;

wherein said high-frequency exhaust noise attenuation means includes perforations formed in said tailpipe, an outer shell surrounding said tailpipe, a pair of end plates respectively hermetically covering both opening ends of said outer shell in an air-tight manner, and a sound absorption material filling an internal space defined between said outer shell and said tailpipe.

2. An active exhaust-noise attenuation muffler, comprising:

a tailpipe included in an exhaust system;

an exhaust pipe included in the exhaust system;

a microphone arranged in said exhaust pipe for monitoring an exhaust noise being propagated with a moving stream of an exhaust gas flowing through the exhaust pipe;.

a secondary sound source including a loudspeaker arranged upstream of said tailpipe and communicating with an interior of the exhaust pipe, for attenuating low- and mid-ranges of frequencies in the exhaust noise by emitting a secondary sound, which is in opposite phase to the monitored exhaust noise, into the exhaust pipe;

said tailpipe being formed in a flared-out manner such that a cross-sectional area of said tailpipe gradually increases towards a downstream end of said tailpipe, for maintaining a noise-attenuation effect provided by said secondary sound source at a high level by holding a static pressure acting on a vibrating surface of said loudspeaker at a pressure level equal to an atmospheric pressure by radiation of the exhaust gas through tailpipe; and high frequency exhaust noise attenuation means arranged at said tailpipe for attenuating a high-frequency noise component in the exhaust gas;.

wherein said high-frequency exhaust noise attenuation means includes an outer shell surrounding said tailpipe, an end plate hermetically covering an upstream opening end of said outer shell in an air-tight fashion, and said tailpipe being made of porous material.

3. An active exhaust-noise attenuation muffler, comprising:

a tailpipe included in an exhaust system;

an exhaust pipe included in the exhaust system;

a microphone arranged in said exhaust pipe for monitoring an exhaust noise being propagated with a moving stream of an exhaust gas flowing through the exhaust pipe;

a secondary sound source including a loudspeaker arranged upstream of said tailpipe and communicating with an interior of the exhaust pipe, for attenuating low- and mid-ranges of frequencies in the exhaust noise by emitting a secondary sound, which is in opposite phase to the monitored exhaust noise, into the exhaust pipe;

said tailpipe being formed in a flared-out manner such that a cross-sectional area of said tailpipe gradually increases towards a downstream end of said tailpipe, for maintaining a noise-attenuation effect provided by said secondary sound source at a high level by holding a static pressure acting on a vibrating surface of said loudspeaker at a pressure level equal to an atmospheric pressure by radiation of the exhaust gas through said tailpipe; and high-frequency exhaust noise attenuation means arranged at said tailpipe for attenuating a high-frequency noise component in the exhaust gas;

wherein said high-frequency exhaust noise attenuation means includes an outer shell surrounding said tailpipe, at least one support member supporting said outer shell on said tailpipe in a manner which permits atmospheric air to flow through both upstream and downstream opening ends of said outer shell via said support member, and said tailpipe being made of porous material.

* * * * *